US010155320B2

(12) United States Patent
Ren

(10) Patent No.: US 10,155,320 B2
(45) Date of Patent: Dec. 18, 2018

(54) SCRATCH-RESISTANT RAZOR HEAD HAVING RESILIENT LEGS AND RAZOR WITH THE SAME

(71) Applicant: Xiangrong Ren, Wenzhou (CN)

(72) Inventor: Xiangrong Ren, Wenzhou (CN)

( * ) Notice: Subject to any disclaimer, the term of this patent is extended or adjusted under 35 U.S.C. 154(b) by 186 days.

(21) Appl. No.: 15/083,483

(22) Filed: Mar. 29, 2016

(65) Prior Publication Data

US 2016/0207210 A1 Jul. 21, 2016

(30) Foreign Application Priority Data

Feb. 24, 2016 (CN) ..... 2016 1 0100878

(51) Int. Cl.

| | |
|---|---|
| ***B26B 21/40*** | (2006.01) |
| ***B26B 21/44*** | (2006.01) |
| ***B26B 21/22*** | (2006.01) |
| ***B26B 21/34*** | (2006.01) |

(52) U.S. Cl.

CPC ..... *B26B 21/4012* (2013.01); *B26B 21/222* (2013.01); *B26B 21/34* (2013.01); *B26B 21/443* (2013.01)

(58) Field of Classification Search

CPC ..... B26B 21/4018; B26B 21/4012; B26B 21/443; B26B 21/4031; B26B 21/227; B26B 53/645; B26B 21/565; B26B 21/4068; B26B 21/4075; B26B 21/222

USPC ... 30/34.2, 50, 526, 527, 532, 47, 63, 346.5, 30/77, 84, 41, 41.5, 57, 48

See application file for complete search history.

(56) References Cited

U.S. PATENT DOCUMENTS

| | | | | |
|---|---|---|---|---|
| 4,492,024 | A * | 1/1985 | Jacobson | B26B 21/227 30/50 |
| 5,224,267 | A * | 7/1993 | Simms | B26B 21/4068 30/50 |
| 6,035,537 | A * | 3/2000 | Apprille, Jr. | B26B 21/227 30/346.5 |
| 8,336,212 | B2 * | 12/2012 | Bozikis | B26B 21/227 30/50 |
| 2010/0154221 | A1 | 6/2010 | De Benedetto | |
| 2012/0047743 | A1 * | 3/2012 | Kemos | B21D 53/645 30/32 |
| 2015/0174774 | A1 * | 6/2015 | Hodgson | B26B 21/14 30/34.2 |

FOREIGN PATENT DOCUMENTS

| | | |
|---|---|---|
| CN | 101472717 A | 7/2009 |
| CN | 201405368 Y | 2/2010 |
| CN | 201415414 Y | 3/2010 |

* cited by examiner

*Primary Examiner* — Ghassem Alie
(74) *Attorney, Agent, or Firm* — Shimokaji IP

(57) ABSTRACT

A scratch-resistant razor head includes a head frame and a razor blade including a support bar having an inclined platform and a blade portion mounted on the inclined platform. An angle between a cutting edge of the blade portion and a front end face of the inclined platform is greater than 0 degree and less than or equal to 0.5 degree; two resilient legs are respectively extended from the left and right frame walls and toward each other, each resilient leg includes an resilient inclined leg and a receiving leg extended from the inclined leg along the direction of the first axis, a convex point is formed by projecting from a top surface of the receiving leg, and the convex point is contacted with the inclined platform. A razor with such a razor head is also provided.

18 Claims, 10 Drawing Sheets

SCRATCH-RESISTANT RAZOR HEAD HAVING RESILIENT LEGS AND RAZOR WITH THE SAME

FIELD OF THE INVENTION

The present invention relates to a razor apparatus and, more particularly to a scratch-resistant razor head having resilient legs and a razor with the same.

BACKGROUND OF THE INVENTION

With improvement of the economy and the society, abounding consumables are offered to people to satisfy people's demand, thereby improving people's standard of living. While razors are one of these consumables.

Currently, the razors have two types including electric razors and manual razors. Regarding the manual razors, a normal usage time of the razor is depended on the razor blades of the razor head thereof. User needs replace with a new razor blade if the old razor blade of the razor head is damaged or dull, in order to ensure the normal usage. Therefore, the razor blade and a suitable installation thereof play an important role in maintaining the shaving effect and service life of the manual razors.

Commonly, the razor blades of the razor head of the conventional manual razor do a draw-cut actuation on the beards, so as to actualize the action of shaving, and the razor blades of the razor head are arranged in a direction perpendicular to the direction that the user pulls the handle thereof. However, cutting edge of the razor blades may appear some indentations in different positions due to it was rigidly impacted by the beards, which on one hand pull the skin and pain the user during the shaving process, thereby causing discomfort, and on the other hand, increase the cost of the manual razor due to the replacement of the razor head.

In order to overcome the above-mentioned drawbacks, a razor with a razor blade being inclined relative to the pulling direction is provided, and the razor blades are inclined to cut the beards so as to reduce the cost thereof and improve the shaving effect. However, as the razor blades are inclined, the shaved skin area at two ends of the razor blade is uneven, specifically, is large at one end and small at the other end, so the skin pressed to be arched by the two ends of the razor blade is also large at one end and small at the other end during shaving process, and the resistances between the two ends of the razor blade and the arched skin are different, so that the razor blade can easily cut into the skin, thereby easily scratching the user.

Thus, there is a need for a razor head and a razor being capable of preventing scratch and improving shaving effect to overcome the above-mentioned drawbacks.

SUMMARY OF THE INVENTION

One objective of the present invention is to provide a razor head being capable of preventing scratch and improving shaving effect.

Another objective of the present invention is to provide a razor being capable of preventing scratch and improving shaving effect.

To achieve the above-mentioned objectives, a scratch-resistant razor head having resilient legs includes a head frame and a razor blade, wherein the head frame includes a front frame wall, a rear frame wall, a left frame wall, and a right frame wall, the front frame wall is arranged along a direction of a first axis, the rear frame wall is arranged along the direction of the first axis and spaced from the front frame wall along a direction of a second axis, the left frame wall is connected to left ends of the front frame wall and the rear frame wall along the direction of the second axis, and the right frame wall is connected to right ends of the front frame wall and the rear frame wall along the direction of the second axis and spaced from the left frame wall along the direction of the first axis; the razor blade includes a sheet support bar disposed along the direction of the first axis and a sheet blade portion, left and right ends of the support bar are respectively installed in the left frame wall and the right frame wall, and an inclined platform inclined upwardly is bent and extended from the top of the support bar along a direction of getting close to the front frame wall, a rear end of the blade portion is mounted on the inclined platform, and a front end of the blade portion is extended beyond a front end face of the inclined platform along an inclined direction of the inclined platform; wherein the front end face of the inclined platform is a plane and parallel to the first axis, a cutting edge of the blade portion is a line and coplanar with the first axis, the cutting edge is inclined relative to the first axis along the direction of the first axis, and an angle between the cutting edge and the front end face is greater than 0 degree and less than or equal to 0.5 degree; wherein two resilient legs located beneath the inclined platform are respectively extended from the left frame wall and the right frame wall along the direction of the first axis and toward each other, each resilient leg comprises an resilient inclined leg inclined upwardly and toward the inclined platform and a receiving leg extended from the inclined leg along the direction of the first axis, a convex point is formed by projecting from a top surface of the receiving leg, and the convex point is contacted with the inclined platform.

To achieve the above-mentioned objectives, a scratch-resistant razor head having resilient legs includes a head frame and a razor blade, the head frame includes a front frame wall, a rear frame wall, a left frame wall, and a right frame wall, the front frame wall is arranged along a direction of a first axis, the rear frame wall is arranged along the direction of the first axis and spaced from the front frame wall along a direction of a second axis, the left frame wall is connected to left ends of the front frame wall and the rear frame wall along the direction of the second axis, and a left guide slot is opened in the left frame wall along a direction of a third axis, the right frame wall is connected to right ends of the front frame wall and the rear frame wall along the direction of the second axis and spaced from the left frame wall along the direction of the first axis, a right guide slot is opened in the right frame wall along the direction of the third axis, and the right guide slot and the left guide slot are aligned along the direction of the first axis, the razor blade includes a sheet support bar disposed along the direction of the first axis and a sheet blade portion, left and right ends of the support bar are respectively inserted into the left and right guide slots along the direction of the third axis, and an inclined platform inclined upwardly is bent and extended from the top of the support bar along a direction of getting close to the front frame wall, a rear end of the blade portion is mounted on the inclined platform, and a front end of the blade portion is extended beyond a front end face of the inclined platform along an inclined direction of the inclined platform; wherein the front end face of the inclined platform is a plane and parallel to the first axis, a cutting edge of the blade portion is a line and coplanar with the first axis, the cutting edge is inclined relative to the first axis along the direction of the first axis, and an angle between the cutting edge and the front end face is greater than 0 degree and less than or equal to 0.5 degree; wherein two resilient legs located beneath the inclined platform are respectively extended from the left frame wall and the right frame wall along the direction of the first axis and toward each other, each resilient leg comprises an resilient inclined leg inclined upwardly and toward the inclined platform and a receiving leg extended from the inclined leg along the direction of the first axis, a convex point is formed by projecting from a top surface of the receiving leg, and the convex point is contacted with the inclined platform.

Concretely, an arc-shaped transition surface projected outwardly relative to the top surface of the receiving leg is connected between the top surface of the receiving leg and the convex point.

Concretely, the convex point is located just above the center of the top surface of the receiving leg.

Concretely, the blade portion comprises a flat portion parallel to the inclined platform and a tip extended forwardly from a front end of the flat portion along the inclined direction of the inclined platform and beyond the front end face of the inclined platform, an upper surface of the tip is a plane inclined downwardly relative to the flat portion, a lower surface of the tip is a plane inclined upwardly relative to the flat portion, and the cutting edge is formed at the connection position where the upper surface meets the lower surface.

Concretely, a cross section of the tip perpendicular to the first axis is an isosceles triangle, and the upper and lower surfaces constitute two equal sides of the isosceles triangle.

Concretely, an angle between the inclined platform and the support bar is in a rang of 110 degree~120 degree, the upper surface and the lower surface are planes in a shape of a parallelogram, and an angle between the upper surface and the lower surface is in a rang of 25 degree~30 degree.

Concretely, two opposite walls of an upper end of the left guide slot respectively have a left inclined surface, two left inclined surfaces extend upwardly and away from each other, two opposite walls of an upper end of the right guide slot respectively have a right inclined surface, and two right inclined surfaces extend upwardly and away from each other, Concretely, an angle between the receiving leg and the inclined leg is in range of 135 degree~140 degree.

Concretely, the first axis is the X axis, the second axis is the Y axis, and the third axis is the Z axis.

To achieve the above-mentioned objectives, a scratch-resistant razor having resilient legs includes a handle for user to hold and a scratch-resistant razor head having resilient legs, the scratch-resistant razor head having resilient legs is mounted on the handle, wherein the scratch-resistant razor head having resilient legs includes a head frame and a razor blade, wherein the head frame includes a front frame wall, a rear frame wall, a left frame wall, and a right frame wall, the front frame wall is arranged along a direction of a first axis, the rear frame wall is arranged along the direction of the first axis and spaced from the front frame wall along a direction of a second axis, the left frame wall is connected to left ends of the front frame wall and the rear frame wall along the direction of the second axis, and the right frame wall is connected to right ends of the front frame wall and the rear frame wall along the direction of the second axis and spaced from the left frame wall along the direction of the first axis; the razor blade includes a sheet support bar disposed along the direction of the first axis and a sheet blade portion, left and right ends of the support bar are respectively installed in the left frame wall and the right frame wall, and an inclined platform inclined upwardly is bent and extended from the top of the support bar along a direction of getting close to the front frame wall, a rear end of the blade portion is mounted on the inclined platform, and a front end of the blade portion is extended beyond a front end face of the inclined platform along an inclined direction of the inclined platform; wherein the front end face of the inclined platform is a plane and parallel to the first axis, a cutting edge of the blade portion is a line and coplanar with the first axis, the cutting edge is inclined relative to the first axis along the direction of the first axis, and an angle between the cutting edge and the front end face is greater than 0 degree and less than or equal to 0.5 degree; wherein two resilient legs located beneath the inclined platform are respectively extended from the left frame wall and the right frame wall along the direction of the first axis and toward each other, each resilient leg comprises an resilient inclined leg inclined upwardly and toward the inclined platform and a receiving leg extended from the inclined leg along the direction of the first axis, a convex point is formed by projecting from a top surface of the receiving leg, and the convex point is contacted with the inclined platform.

Concretely, a left guide slot is opened in the left frame wall along a direction of a third axis, a right guide slot is opened in the right frame wall along the direction of the third axis, the right guide slot and the left guide slot are aligned along the direction of the first axis, and the left and right ends of the support bar are respectively inserted into the left and right guide slots along the direction of the third axis.

Concretely, an arc-shaped transition surface projected outwardly relative to the top surface of the receiving leg is connected between the top surface of the receiving leg and the convex point.

Concretely, the convex point is located just above the center of the top surface of the receiving leg.

Concretely, the blade portion comprises a flat portion parallel to the inclined platform and a tip extended forwardly from a front end of the flat portion along the inclined direction of the inclined platform and beyond the front end face of the inclined platform, an upper surface of the tip is a plane inclined downwardly relative to the flat portion, a lower surface of the tip is a plane inclined upwardly relative to the flat portion, and the cutting edge is formed at the connection position where the upper surface meets the lower surface.

Concretely, a cross section of the tip perpendicular to the first axis is an isosceles triangle, and the upper and lower surfaces constitute two equal sides of the isosceles triangle.

Concretely, an angle between the inclined platform and the support bar is in a rang of 110 degree~120 degree, the upper surface and the lower surface are planes in a shape of a parallelogram, and an angle between the upper surface and the lower surface is in a rang of 25 degree~30 degree.

Concretely, two opposite walls of an upper end of the left guide slot respectively have a left inclined surface, two left inclined surfaces extend upwardly and away from each other, two opposite walls of an upper end of the right guide slot respectively have a right inclined surface, and two right inclined surfaces extend upwardly and away from each other, Concretely, an angle between the receiving leg and the inclined leg is in range of 135 degree~140 degree.

Concretely, the first axis is the X axis, the second axis is the Y axis, and the third axis is the Z axis.

In comparison with the prior art, since the front end face of the inclined platform is a plane and parallel to the first axis, a cutting edge of the blade portion is a line and coplanar with the first axis, the cutting edge is inclined relative to the first axis along the direction of the first axis, and an angle between the cutting edge and the front end face is greater than 0 degree and less than or equal to 0.5 degree, so that the cutting edge is located in front of the front end face and slightly inclined relative to the front end face along the direction of the first axis. That is, the distances from the different positions of the cutting edge to the front end face are different, as a result, besides a draw-cut action, the shaving action of the razor blade further includes a cutting action, even if the cutting edge of the razor blades appears some indentations, the razor blade with indentations also can firstly cut a notch in the beard by inclined cutting way and then cut off the beard, thereby enhancing the shaving effect. In addition, two resilient legs located beneath the inclined platform are respectively extended from the left frame wall and the right frame wall along the direction of the first axis and toward each other, each resilient leg includes an resilient inclined leg inclined upwardly toward the inclined platform and a receiving leg extended from the inclined leg along the direction of the first axis, a convex point is formed by projecting from a top surface of the receiving leg, and the convex point is contacted with the inclined platform. Point contact between the razor blade and the resilient leg is implemented by the inclined platform and the convex point, and the razor blade will not be interfered by other portion of the resilient leg and in turn can reliably push the resilient leg to be elastically deformed when shaving. So that when the razor blades are inclined to cut the beards, the arched skin pushes the razor blades to be elastically deformed to reduce the resistances of the razor blades, thus the razor blades can be closely contacted with the skin and meanwhile easily slipped the arched skin so as to achieve the purpose of shaving, thereby effectively avoiding that the razor blades cut into the skin. Therefore, the scratch-resistant razor head having resilient legs is capable of improving shaving effect, preventing scratch and extending normal service life.

BRIEF DESCRIPTION OF THE DRAWINGS

The accompanying drawings facilitate an understanding of the various embodiments of this invention. In such drawings.

DETAILED DESCRIPTION OF ILLUSTRATED EMBODIMENTS

A distinct and full description of the technical solution of the present invention will follow by combining with the accompanying drawings. By all appearances, the embodiments to be described just are a part of embodiments of the present invention, not the all. Based on the embodiment of the present invention, all other embodiments obtained by the person ordinarily skilled in the art without any creative work pertain to the protection scope of the present invention.

Figure 1:
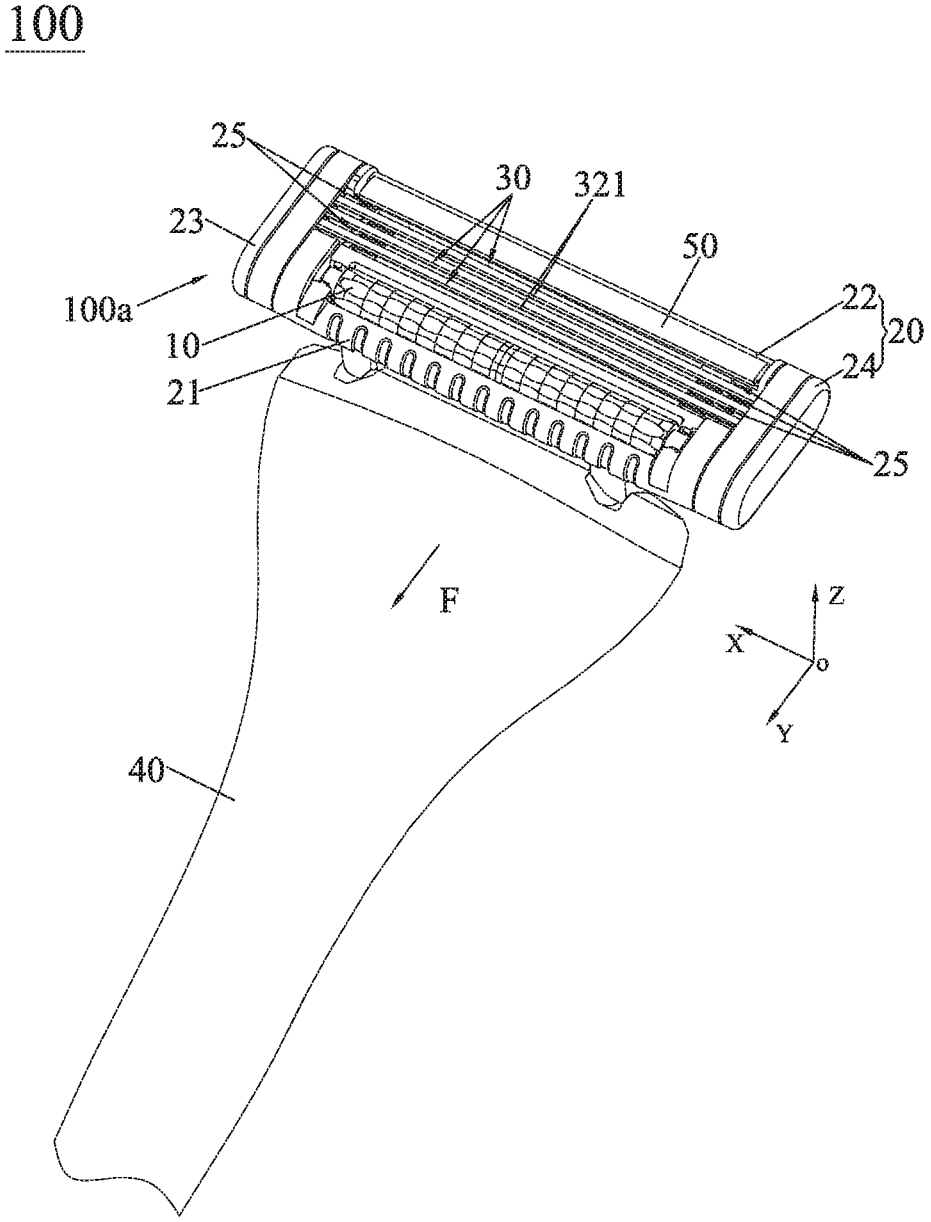
FIG. 1 is a perspective view of a scratch-resistant razor according to a first embodiment of the present invention.
Figure 2:
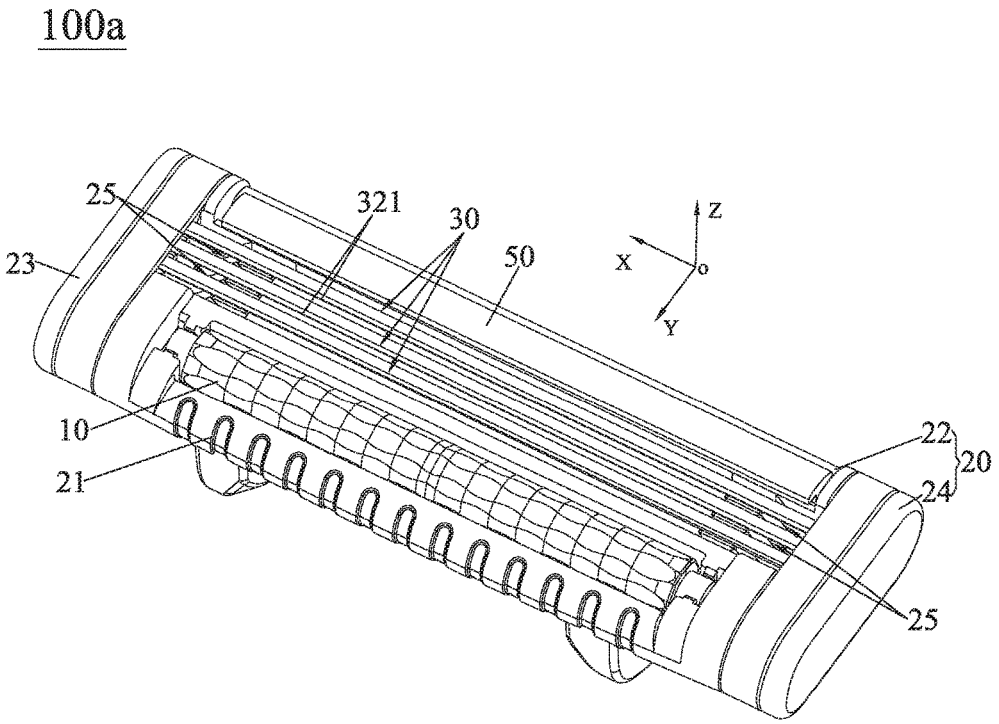
FIG. 2 is a perspective view of a scratch-resistant razor head according to the first embodiment of the present invention.
Figure 3:
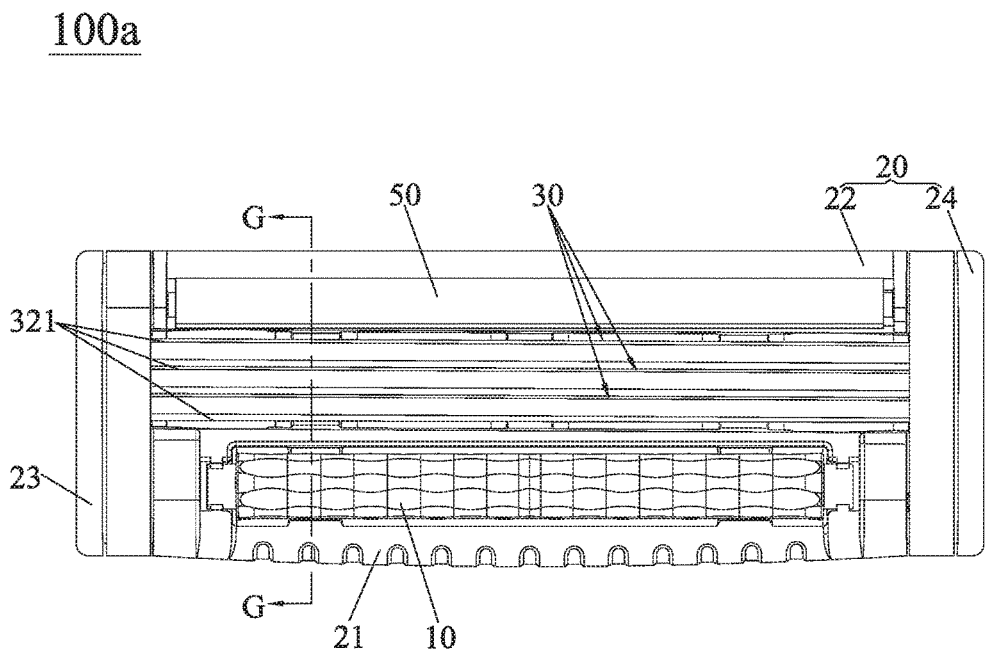
FIG. 3 is a plan view of a scratch-resistant razor head according to the first embodiment of the present invention.
Figure 4:
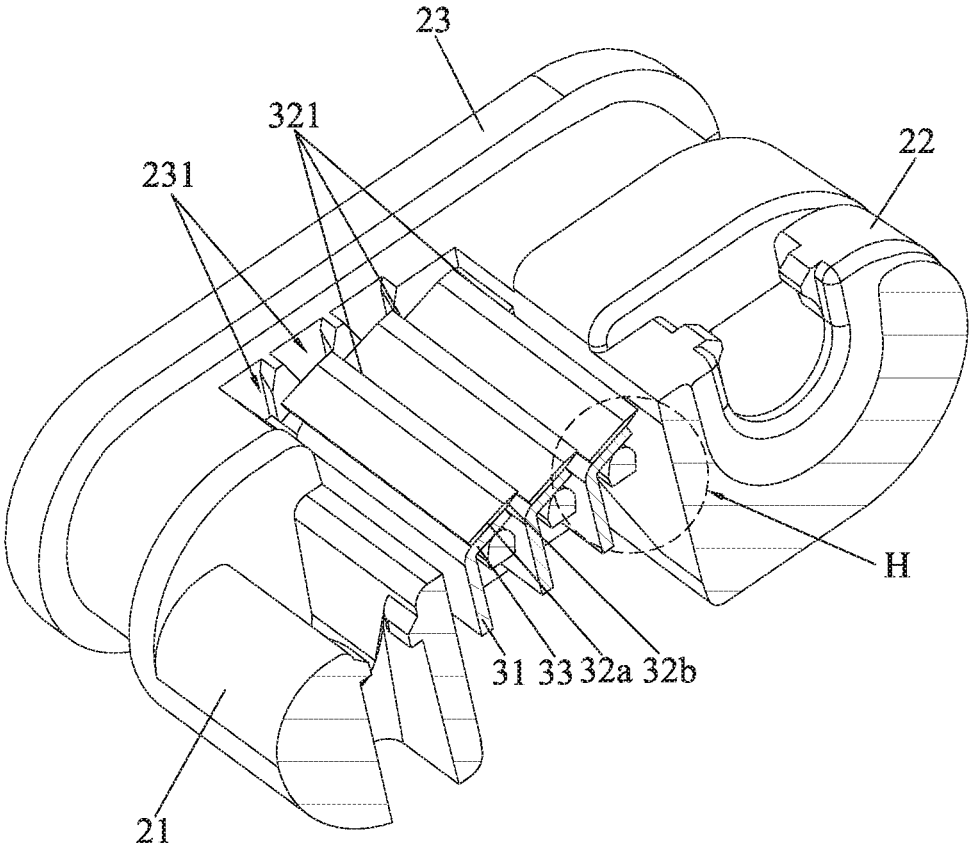
FIG. 4 is a cross-sectional view along the line G-G in FIG. 3.

Referring to FIG. 1, it shows a scratch-resistant 100 with a handle 40 for user to hold and a scratch-resistant razor head 100*a* according to a first embodiment of the present invention. As illustrated, the scratch-resistant razor head 100*a* is mounted on the handle 40, when the user draw the handle 40 along an arrow direction F in handle 40 of FIG. 1, the scratch-resistant razor head 100*a* can rotate relative to the handle 40 so as to shave the beards.

Concretely, referring to FIGS. 2-5, the scratch-resistant razor head 100*a* includes a head frame 20 and at least one razor blade 30. Concretely, in the present embodiment, the scratch-resistant razor head 100*a* further includes a guide roller 10, the guide roller 10 is preferably shaped as a columnar structure, and the side face of the guide roller 10 is provided with concave-convex structure, in order to increase the rolling and guiding effect of the guide roller 10, but not limited thereto.

As shown in FIGS. 2, 3, 8 and 9, the head frame 20 includes a front frame wall 21, a rear frame wall 22, a left frame wall 23, and a right frame wall 24, the front frame wall 21 is arranged along a direction of a first axis, preferably, in the present embodiment, the first axis is the X axis of the three-dimensional coordinates, but not limited thereto. The guide roller 10 is arranged along a direction of the first axis and is rotatably installed on the front frame wall 21, so as to roll firstly on the skin and then provide guiding effect during shaving process. The rear frame wall 22 is arranged along the direction of the first axis and spaced from the front frame wall 21 along a direction of a second axis, preferably, in the present embodiment, the second axis is the Y axis of the three-dimensional coordinates, but not limited thereto, that is, the rear frame wall 22 is spaced from the front frame wall 21 along the direction of Y axis. The left frame wall 23 is connected to left ends of the front frame wall 21 and the rear frame wall 22 along the direction of the second axis, preferably, in the present embodiment, at least one left guide slot 231 is opened in the left frame wall 23 along a direction of a third axis, and the third axis is the Z axis of the three-dimensional coordinates, but not limited thereto. Preferably, two opposite walls of an upper end of each left guide slot 231 respectively have a left inclined surface 2311, two left inclined surfaces 2311 extend upwardly and away from each other, so as to facilitate a support bar 31 to be slid into the left guide slot 231 along the direction of the Z axis. The right frame wall 24 is connected to right ends of the front frame wall 21 and the rear frame wall 22 along the direction of the second axis and spaced from the left frame wall 23 along the direction of the first axis, that is, there is a certain distance between the right frame wall 24 and the left frame wall 23 along the first axis direction. Preferably, in the present embodiment, at least one right guide slot 214 is opened in the right frame wall 24 along the direction of the third axis, and the right guide slot 241 and the left guide slot 231 are aligned along the direction of the first axis. Preferably, two opposite walls of an upper end of the right guide slot 241 respectively have a right inclined surface 2411, and two right inclined surfaces 2411 extend upwardly and away from each other, so that the support bar 31 can be moved up and down within the left and right guide slots 231, 241 easily and reliably, and thereby facilitating the razor blade 30 to push the resilient leg 25 described below to be elastically deformed.

As shown in FIGS. 4 to 7, the razor blade 30 includes a sheet blade portion 32 and a sheet support bar 31 disposed along the direction of the first axis, preferably, in the present embodiment, the blade portion 32 is welded to the support bar 31, of course, in other embodiments, the razor blade 30 can be an integral structure and the blade portion 31 is formed by bending process, so it is not limited thereto. Left and right ends of the support bar 31 are respectively installed in the left frame wall 23 and the right frame wall 24, preferably, the left and right ends of the support bar 31 are respectively inserted into the left and right guide slots 2311, 2411 along the direction of the third axis, and an inclined platform 33 inclined upwardly is bent and extended from the top of the support bar 31 along a direction of getting close to the front frame wall 21. Preferably, the angle c between the inclined platform 33 and the support bar 31 is in a range of 110 degree~120 degree, such as 110 degree, 115 degree, 118 degree or 120 degree, and the lower surface of the inclined platform 33 can be maintained to contact with the convex point 253 described below so as to ensure the reliability of the point contact between the inclined platform 33 and the convex point 253. A rear end of the blade portion 32 is mounted on the inclined platform 33, such as is welded to the inclined platform 33 by welding method, a front end of the blade portion 32 is extended beyond a front end face 331 of the inclined platform 33 along an inclined direction (the direction of the arrow near the inclined platform 33 in FIG. 7) of the inclined platform 33, so that the blade portion 32 is extended beyond the front end face 331 of the inclined platform 33 and located in front of the front end face 331.

Figure 6:
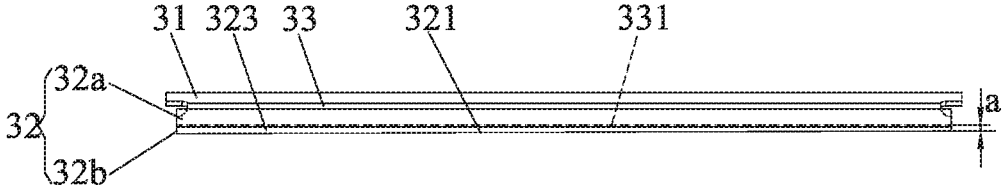
FIG. 6 is a plan view of a razor blade of the scratch-resistant razor head according to the first embodiment of the present invention.
Figure 7:
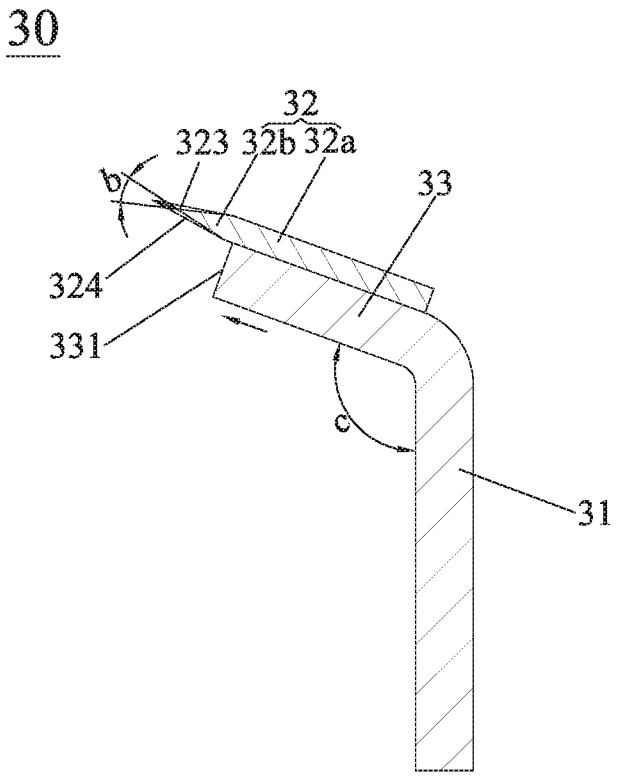
FIG. 7 is a cross-sectional view of the razor blade in FIG. 6.
Figure 8:
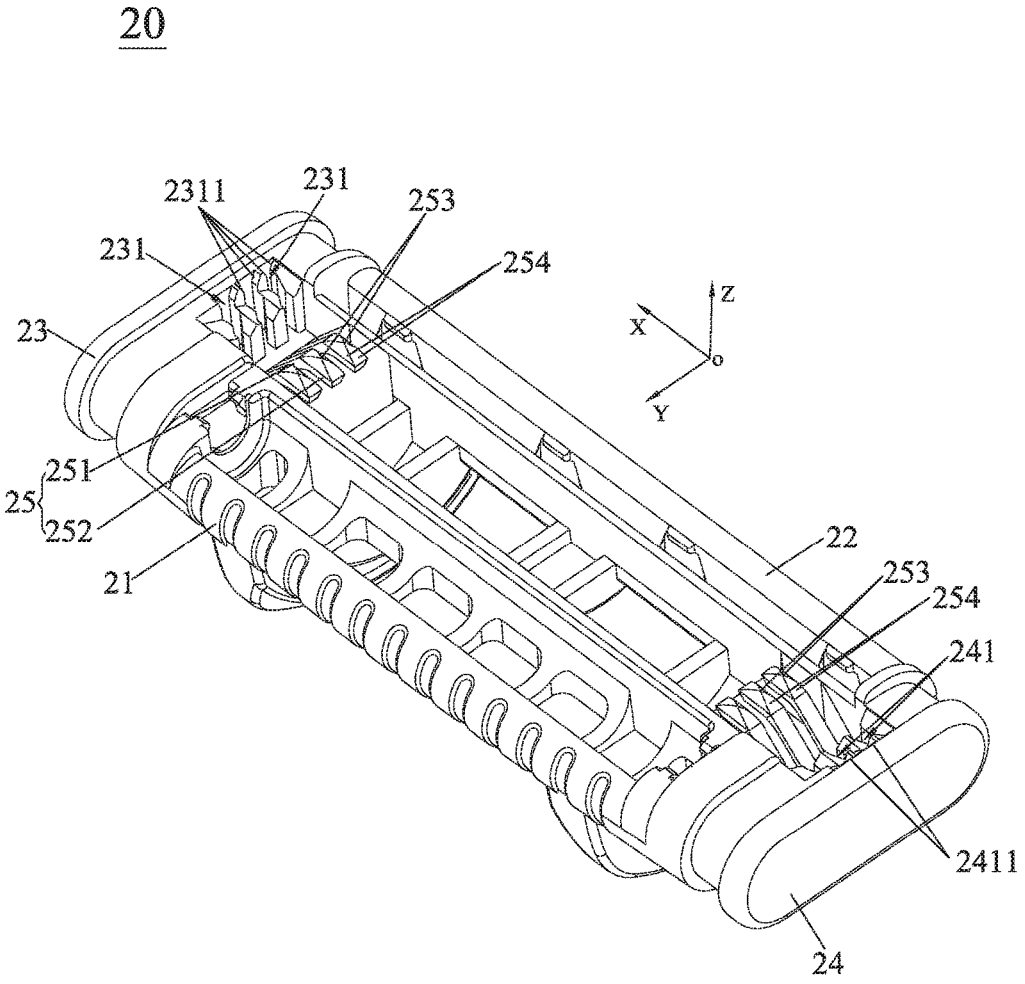
FIG. 8 is a perspective view of a head frame of a scratch-resistant razor head according to a first embodiment of the present invention.

As shown in FIG. 7, the front end face 331 of the inclined platform 33 is a plane and parallel to the first axis, a cutting edge 321 of the blade portion 32 is a line and coplanar with the first axis, that is, the cutting edge 321 and the first axis are in a same plane, the cutting edge 321 is inclined relative to the first axis along the direction of the first axis, and an angle a between the cutting edge 321 and the front end face 331 is greater than 0 degree and less than or equal to 0.5 degree, such as 0.1 degree, 0.2 degree, 0.3 degree, 0.4 degree or 0.5 degree, as shown in FIG. 6. The cutting edge 321 is slightly inclined frontward relative to the front end face 331, and the razor blade 30 can shave the beards with an inclined cutting way relative to the drawing direction of the handle 40 (the arrow direction F in FIG. 1), namely, the scratch-resistant razor head 100*a* of the present invention is capable of cutting function. In the present embodiment, the axis line of the guide roller 10 and the X axis are perpendicular to the drawing direction of the handle 40.

Figure 5:
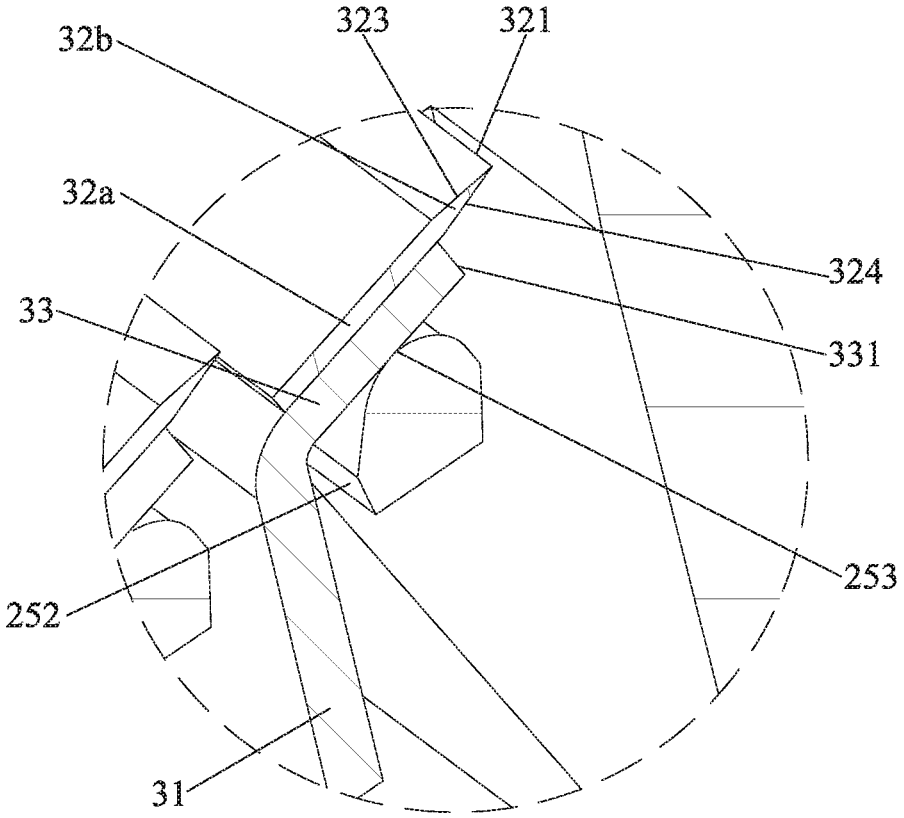
FIG. 5 is an enlarged view of portion H in FIG. 4.
Figure 9:
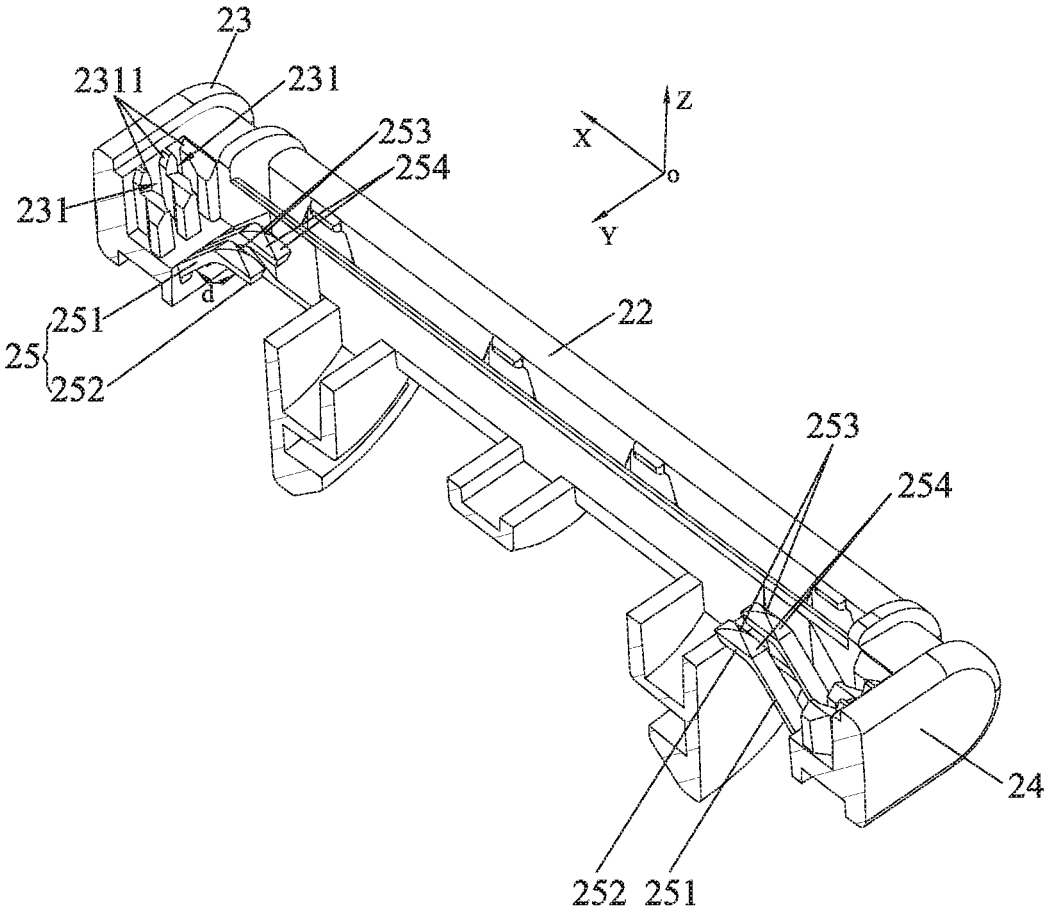
FIG. 9 is a perspective view showing the internal structure of the head frame in FIG. 8 after being sectioned lengthways.
Figure 10:
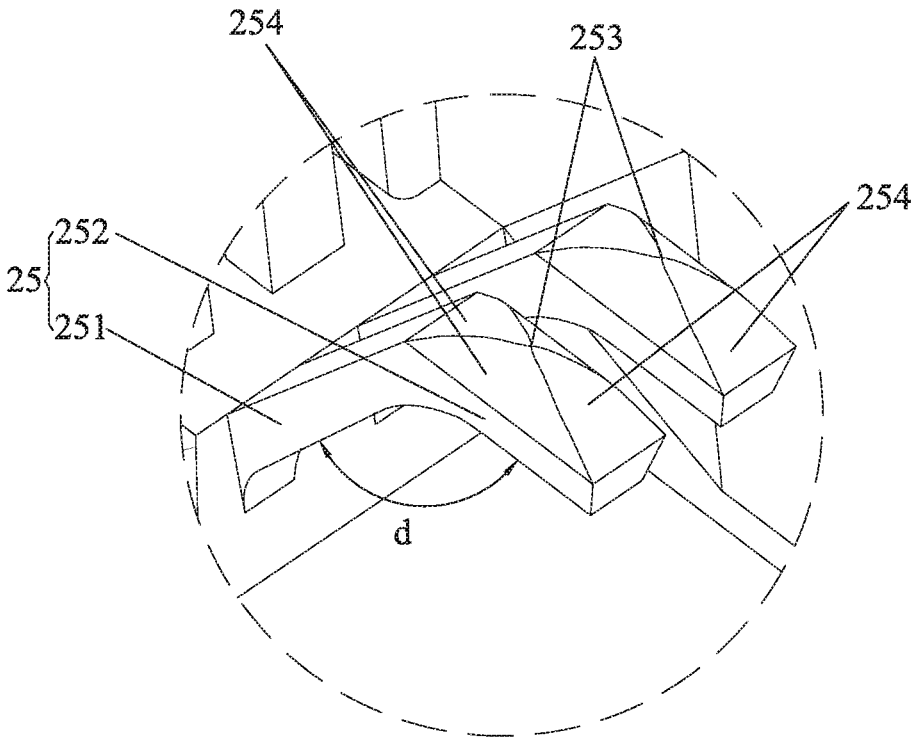
FIG. 10 is an enlarged view of portion I in FIG. 9.

As shown in FIGS. 4, 5 8 and 9, two resilient legs 25 located beneath the inclined platform 33 are respectively extended from the left frame wall 23 and the right frame wall 24 along the direction of the first axis and toward each other, each resilient leg 25 includes an resilient inclined leg 251 inclined upwardly and toward the inclined platform 33 and a receiving leg 252 extended from the inclined leg 251 along the direction of the first axis. Preferably, as shown in FIGS. 9 and 10, in the present embodiment, the angle d between the receiving leg 252 and the inclined leg 251 is in a range of 135 degree~140 degree, such as 135 degree, 138 degree or 140 degree, so that the receiving leg 252 of the resilient leg 25 can be close to the center of the razor blade 30 along the direction of the first axis, which can prevent the center of the razor blade 30 from bending or deforming downward by its gravity, thereby providing a more reliable support to the razor blade 30. A convex point 253 is formed by projecting from a top surface of the receiving leg 252, and the convex point 253 is contacted with the inclined platform 33, as shown in FIG. 5. Preferably, as shown in FIG. 10, an arc-shaped transition surface 254 projected outwardly relative to the top surface of the receiving leg 252 is connected between the top surface of the receiving leg 252 and the convex point 253, the convex point 253 can be maintained to be contacted with the inclined platform 33 during shaving process and specifically during the elastic deformation process of the resilient leg 25, so that the razor blade can be easily slipped the arched skin between the guide roller 10 and the razor blade 30 so as to achieve the purpose of shaving and prevent scratch. Thus, the scratch-resistant razor head 100*a* has an improved security. Preferably, in the present embodiment, the convex point 253 is located just above the center of the top surface of the receiving leg 252, and the top surface of the receiving leg 252 is in a shape of a parallelogram.

Concretely, as shown in FIGS. 6 and 7, the blade portion 32 includes a flat portion 32*a* parallel to the inclined platform 33 and a tip 32*b* extended forwardly from a front end of the flat portion 32*a* along the inclined direction (the direction of the arrow near the inclined platform 33 in FIG. 7) of the inclined platform 33 and beyond the front end face 331 of the inclined platform 33, an upper surface 323 of the tip 32*b* is a plane inclined downwardly relative to the flat portion 32*a*, a lower surface 324 of the tip 32*b* is a plane inclined upwardly relative to the flat portion 32*a*, and the cutting edge 321 is formed at the connection position where the upper surface 323 meets the lower surface 324. Concretely, in the present embodiment, as shown in FIG. 7, a cross section of the tip 32*b* perpendicular to the first axis is an isosceles triangle, and the upper and lower surfaces 323, 324 constitute two equal sides of the isosceles triangle. Preferably, the upper surface 323 and the lower surface 324 are planes in a shape of a parallelogram, and an angle b between the upper surface 323 and the lower surface 324 is in a rang of 25 degree~30 degree, such as 25 degree, 27 degree, 29 degree and 30 degree.

In comparison with the prior art, since the front end face 331 of the inclined platform 33 is a plane and parallel to the first axis, the cutting edge 321 of the blade portion 32 is a line and coplanar with the first axis, the cutting edge 321 is inclined relative to the first axis along the direction of the first axis, and the angle a between the cutting edge 321 and the front end face 331 is greater than 0 degree and less than or equal to 0.5 degree, so that the cutting edge 321 is located in front of the front end face 331 and slightly inclined relative to the front end face 331 along the direction of the first axis. That is, the distances from the different positions of the cutting edge 321 to the front end face 331 are different, as a result, besides a draw-cut action, the shaving action of the razor blade 30 further includes a cutting action, even if the cutting edge 321 of the razor blades 30 appears some indentations, the razor blade 30 with indentations also can firstly cut a notch in the beard by inclined cutting way and then cut off the beard, thereby enhancing the shaving effect. In addition, two resilient legs 25 located beneath the inclined platform 33 are respectively extended from the left frame wall 23 and the right frame wall 24 along the direction of the first axis and toward each other, each resilient leg 25 includes an resilient inclined leg 251 inclined upwardly toward the inclined platform 33 and a receiving leg 252 extended from the inclined leg 251 along the direction of the first axis, a convex point 253 is formed by projecting from a top surface of the receiving leg 252, and the convex point 253 is contacted with the inclined platform 33. Point contact between the razor blade 30 and the resilient leg 25 is implemented by the inclined platform 33 and the convex point 253, and the razor blade 30 will not be interfered by other portion of the resilient leg 25 and in turn can reliably push the resilient leg 25 to be elastically deformed when shaving. So that when the razor blades 30 are inclined to cut the beards, the arched skin pushes the razor blades 30 to be elastically deformed in order to reduce the resistances of the razor blades 30, thus the razor blades 30 can be closely contacted with the skin and meanwhile easily slipped the arched skin so as to achieve the purpose of shaving, thereby effectively avoiding that the razor blades 30 may cut into the skin. Therefore, the scratch-resistant razor head 100*a* is capable of improving shaving effect, preventing scratch and extending normal service life.

It is noteworthy that, in other embodiments, the guide roller 10 can be removed, the objectives of the present invention also can be achieved. Additionally, in order to improve the lubricating effect, a lubricating strip 50 can be configured in the rear frame wall 22 along the direction of the X axis.

While the invention has been described in connection with what are presently considered to be the most practical and preferred embodiments, it is to be understood that the invention is not to be limited to the disclosed embodiments, but on the contrary, is intended to cover various modifications and equivalent arrangements included within the spirit and scope of the invention.

What is claimed is:

1. A scratch-resistant razor head having resilient legs, comprising:

a head frame, the head frame comprising:

a front frame wall arranged along a direction of a first axis;

a rear frame wall arranged along the direction of the first axis and spaced from the front frame wall along a direction of a second axis;

a left frame wall connected to left ends of the front frame wall and the rear frame wall along the direction of the second axis;

a right frame wall connected to right ends of the front frame wall and the rear frame wall along the direction of the second axis and spaced from the left frame wall along the direction of the first axis; and a razor blade, the razor blade comprising:

a sheet support bar disposed along the direction of the first axis, left and right ends of the support bar being respectively installed in the left frame wall and the right frame wall, and an inclined platform inclined upwardly being bent and extended from the top of the support bar along a direction of getting close to the front frame wall; and a sheet blade portion, a rear end of the blade portion being mounted on the inclined platform, and a front end of the blade portion being extended beyond a front end face of the inclined platform along an inclined direction of the inclined platform;

wherein the front end face of the inclined platform is a plane and parallel to the first axis, a cutting edge of the blade portion is a line and coplanar with the first axis, the cutting edge is inclined relative to the first axis along the direction of the first axis, and an angle between the cutting edge and the front end face is greater than or equal to 0.2 degree and less than or equal to 0.5 degree;

wherein two resilient legs located beneath the inclined platform are respectively extended from the left frame wall and the right frame wall along the direction of the first axis and toward each other, each resilient leg comprises an resilient inclined leg inclined upwardly and toward the inclined platform and a receiving leg extended from the inclined leg along the direction of the first axis, a convex point is formed by projecting from a top surface of the receiving leg, the convex point is contacted with the inclined platform, and an angle between the receiving leg and the inclined leg is in range of 135 degree~140 degree.

2. A scratch-resistant razor head having resilient legs, comprising:

a head frame, the head frame comprising:

a front frame wall arranged along a direction of a first axis;

a rear frame wall arranged along the direction of the first axis and spaced from the front frame wall along a direction of a second axis;

a left frame wall connected to left ends of the front frame wall and the rear frame wall along the direction of the second axis, and a left guide slot being opened in the left frame wall along a direction of a third axis;

a right frame wall connected to right ends of the front frame wall and the rear frame wall along the direction of the second axis and spaced from the left frame wall along the direction of the first axis, a right guide slot being opened in the right frame wall along the direction of the third axis, and the right guide slot and the left guide slot being aligned along the direction of the first axis; and a razor blade, the razor blade comprising:

a sheet support bar disposed along the direction of the first axis, left and right ends of the support bar being respectively inserted into the left and right guide slots along the direction of the third axis, and an inclined platform inclined upwardly being bent and extended from the top of the support bar along a direction of getting close to the front frame wall; and a sheet blade portion, a rear end of the blade portion being mounted on the inclined platform, and a front end of the blade portion being extended beyond a front end face of the inclined platform along an inclined direction of the inclined platform;

wherein the front end face of the inclined platform is a plane and parallel to the first axis, a cutting edge of the blade portion is a line and coplanar with the first axis, the cutting edge is inclined relative to the first axis along the direction of the first axis, and an angle between the cutting edge and the front end face is greater than or equal to 0.2 and less than or equal to 0.5 degree;

wherein two resilient legs located beneath the inclined platform are respectively extended from the left frame wall and the right frame wall along the direction of the first axis and toward each other, each resilient leg comprises an resilient inclined leg inclined upwardly and toward the inclined platform and a receiving leg extended from the inclined leg along the direction of the first axis, a convex point is formed by projecting from a top surface of the receiving leg, the convex point is contacted with the inclined platform, and an angle between the receiving leg and the inclined leg is in range of 135 degree~140 degree.

3. The scratch-resistant razor head having resilient legs according to claim 2, wherein an arc-shaped transition surface projected outwardly relative to the top surface of the receiving leg is connected between the top surface of the receiving leg and the convex point.

4. The scratch-resistant razor head having resilient legs according to claim 3, wherein the convex point is located just above the center of the top surface of the receiving leg.

5. The scratch-resistant razor having resilient legs according to claim 3, wherein the convex point is located just above the center of the top surface of the receiving leg.

6. The scratch-resistant razor head having resilient legs according to claim 2, wherein the blade portion comprises a flat portion parallel to the inclined platform and a tip extended forwardly from a front end of the flat portion along the inclined direction of the inclined platform and beyond the front end face of the inclined platform, an upper surface of the tip is a plane inclined downwardly relative to the flat portion, a lower surface of the tip is a plane inclined upwardly relative to the flat portion, and the cutting edge is formed at the connection position where the upper surface meets the lower surface.

7. The scratch-resistant razor having resilient legs according to claim 6, wherein a cross section of the tip perpendicular to the first axis is an isosceles triangle, and the upper and lower surfaces constitute two equal sides of the isosceles triangle.

8. The scratch-resistant razor head having resilient legs according to claim 6, wherein a cross section of the tip perpendicular to the first axis is an isosceles triangle, and the upper and lower surfaces constitute two equal sides of the isosceles triangle.

9. The scratch-resistant razor having resilient legs according to claim 8, wherein an angle between the inclined platform and the support bar is in a range of 110 degree~120 degree, the upper surface and the lower surface are planes in a shape of a parallelogram, and an angle between the upper surface and the lower surface is in a range of 25 degree~30 degree.

10. The scratch-resistant razor head having resilient legs according to claim 8, wherein an angle between the inclined platform and the support bar is in a range of 110 degree~120 degree, the upper surface and the lower surface are planes in a shape of a parallelogram, and an angle between the upper surface and the lower surface is in a range of 25 degree~30 degree.

11. The scratch-resistant razor head having resilient legs according to claim 2, wherein two opposite walls of an upper end of the left guide slot respectively have a left inclined surface, two left inclined surfaces extend upwardly and away from each other, two opposite walls of an upper end of the right guide slot respectively have a right inclined surface, and two right inclined surfaces extend upwardly and away from each other.

12. The scratch-resistant razor head having resilient legs according to claim 2, wherein the first axis is the X axis, the second axis is the Y axis, and the third axis is the Z axis.

13. The scratch-resistant razor having resilient legs according to claim 2, wherein a left guide slot is opened in the left frame wall along a direction of a third axis, a right guide slot is opened in the right frame wall along the direction of the third axis, the right guide slot and the left guide slot are aligned along the direction of the first axis, and the left and right ends of the support bar are respectively inserted into the left and right guide slots along the direction of the third axis.

14. The scratch-resistant razor having resilient legs according to claim 2, wherein the blade portion comprises a flat portion parallel to the inclined platform and a tip extended forwardly from a front end of the flat portion along the inclined direction of the inclined platform and beyond the front end face of the inclined platform, an upper surface of the tip is a plane inclined downwardly relative to the flat portion, a lower surface of the tip is a plane inclined upwardly relative to the flat portion, and the cutting edge is formed at the connection position where the upper surface meets the lower surface.

15. The scratch-resistant razor having resilient legs according to claim 2, wherein two opposite walls of an upper end of the left guide slot respectively have a left inclined surface, two left inclined surfaces extend upwardly and away from each other, two opposite walls of an upper end of the right guide slot respectively have a right inclined surface, and two right inclined surfaces extend upwardly and away from each other.

16. The scratch-resistant razor having resilient legs according to claim 2, wherein the first axis is the X axis, the second axis is the Y axis, and the third axis is the Z axis.

17. A scratch-resistant razor having resilient legs, comprising a handle for user to hold and a scratch-resistant razor head having resilient legs, the scratch-resistant razor head having resilient legs is mounted on the handle, wherein the scratch-resistant razor head having resilient legs comprising:

a head frame, the head frame comprising:

a front frame wall arranged along a direction of a first axis;

a rear frame wall arranged along the direction of the first axis and spaced from the front frame wall along a direction of a second axis;

a left frame wall connected to left ends of the front frame wall and the rear frame wall along the direction of the second axis;

a right frame wall connected to right ends of the front frame wall and the rear frame wall along the direction of the second axis and spaced from the left frame wall along the direction of the first axis; and a razor blade, the razor blade comprising:

a sheet support bar disposed along the direction of the first axis, left and right ends of the support bar being respectively installed in the left frame wall and the right frame wall, and an inclined platform inclined upwardly being bent and extended from the top of the support bar along a direction of getting close to the front frame wall; and a sheet blade portion, a rear end of the blade portion being mounted on the inclined platform, and a front end of the blade portion being extended beyond a front end face of the inclined platform along an inclined direction of the inclined platform;

wherein the front end face of the inclined platform is a plane and parallel to the first axis, a cutting edge of the blade portion is a line and coplanar with the first axis, the cutting edge is inclined relative to the first axis along the direction of the first axis, and an angle between the cutting edge and the front end face is greater than or equal to 0.2 and less than or equal to 0.5 degree;

wherein two resilient legs located beneath the inclined platform are respectively extended from the left frame wall and the right frame wall along the direction of the first axis and toward each other, each resilient leg comprises an resilient inclined leg inclined upwardly and toward the inclined platform and a receiving leg extended from the inclined leg along the direction of the first axis, a convex point is formed by projecting from a top surface of the receiving leg, the convex point is contacted with the inclined platform, and an angle between the receiving leg and the inclined leg is in range of 135 degree~140 degree.

18. The scratch-resistant razor having resilient legs according to claim 17, wherein an arc-shaped transition surface projected outwardly relative to the top surface of the receiving leg is connected between the top surface of the receiving leg and the convex point.

* * * * *